United States Patent [19]

Howard

[11] Patent Number: 4,924,046

[45] Date of Patent: May 8, 1990

[54] TRIM SWITCH

[75] Inventor: William A. Howard, Burton, Ohio

[73] Assignee: Delta Systems, Inc., Streetsboro, Ohio

[21] Appl. No.: 249,859

[22] Filed: Sep. 27, 1988

[51] Int. Cl.[5] ..... H01H 13/70

[52] U.S. Cl. ..... 200/516; 200/5 A; 200/534

[58] Field of Search ..... 200/5 A, 552, 406, 332.2, 200/61.54–61.57, 516, 534; 440/87; 74/480 B

[56] References Cited

U.S. PATENT DOCUMENTS 4,343,973 8/1982 Main ..... 200/516

4,476,355 10/1984 Mital ..... 200/5 A 4,801,282 1/1989 Ogawa et al. ..... 440/87

*Primary Examiner*—J. R. Scott

*Attorney, Agent, or Firm*—Watts, Hoffmann, Fisher & Heinke

[57] ABSTRACT

A trim switch control for aligning a motor on a boat. The switch includes a housing in which a switch body is supported. A bridging member includes side lobes having domed contact engaging portions. In response to user actuation, an actuator surface is brought into engagement with the domed side lobes causing deformation of those lobes into engagement with the contacts. This completes an electrical circuit, resulting in user actuated control of the motor trim.

11 Claims, 2 Drawing Sheets

TRIM SWITCH

TECHNICAL FIELD

The present invention concerns a trim switch for raising and lowering the pitch of a motor boat propeller.

BACKGROUND ART

Motor boat throttle controls often include a switch actuated trim control to allow the motorist to re-orient the boat motor thereby adjusting the trim of the motor propeller. By raising and lowering the angle at which the propeller rotates in the water, the smoothness of the boat ride can be adjusted. Thus, the motor boat operator can assess wave conditions and take corrective actions to avoid a choppy, bumpy ride by changing the trim angle at which the propeller rotates.

In the prior art, the control for trim has been positioned in close proximity to the throttle control. In one design, for example, the trim switch has an up/down toggle mechanism mounted directly to the throttle so that as the motor speed is adjusted, the trim can also be easily maintained in an appropriate manner.

It has also been a practice in the past to mount a second parallel trim switch system in the rear of the boat in close proximity to the motor. This allows the operator to raise the motor with the boat out of the water by activating this second parallel trim switch.

Both positions for the trim control result in water coming into direct contact with the trim switch. If water is allowed to seep past the interface between switch control and the boat, electrical shorting and circuit degradation can result.

DISCLOSURE OF THE INVENTION

The present invention concerns a new and improved trim switch control unit for mounting either in the vicinity of the motor throttle or at the rear of the boat next to the motor. The improved design of Applicant's trim switch control seals the switch mechanism from deterioration due to contact with the water and results in a reliable control unit having improved performance characteristics.

In accordance with the invention, the trim switch includes a base for mounting the switch and routing signal carrying conductors away from the switch to a trim switch control for pivoting a boat motor. A switch body has first and second circular depressions located on either side of a center portion. Metal contacts, which preferably comprise rivets, extend through openings centered in the depressions. The contacts are coupled to conductors for routing the switch control signals away from the trim switch.

A metallic bridging element or member connected to the switch body by a third center post contact has two domed side lobes spaced from each other on either sides of the center portion of the switch body. An actuator deforms the switch lobes into engagement with an associated metallic switch contact to complete a circuit path from a switch contact through the center contact to the trim control circuit.

One aspect of the invention is the arrangement between the domed portion of the bridging member and the metallic contacts. When the actuator brings the domed portion into contact with the rounded or curved surface of the switch contact, a tactile switch response is noted by the motor boat operator. Such tactile feedback to the operator provides precise trim switch actuation and precise trim adjustment.

In the preferred embodiment, the switch actuator includes a cover having indicia which indicate the sense (either up or down) in which the trim is being adjusted. The cover also seals the side lobes in an environment free of damaging water intrusion thereby enhancing reliability and lifetime of the trim switch.

In a preferred actuator, a button having an outwardly extending projection engages the domed bridging member in response to user actuation of the switch. The projection includes a curved projection surface that contacts the domed portion of the bridging member to deform the dome in a specified way. More specifically, the dome is deformed in a manner such that the dome engages an extended portion of the switch contact along its curved outer surface. This assures reliable circuit operation due to increased area contact between the bridging member and the contact.

From the above it is appreciated that one object of the invention is a new and improved switch providing reliable operation for use in a trim control of a motor boat. This and other objects, advantages and features of the invention will become better understood from a detailed description of a preferred embodiment of the invention which is described in conjunction with the accompanying drawings.

BEST MODE FOR CARRYING OUT THE INVENTION

Figure 1:
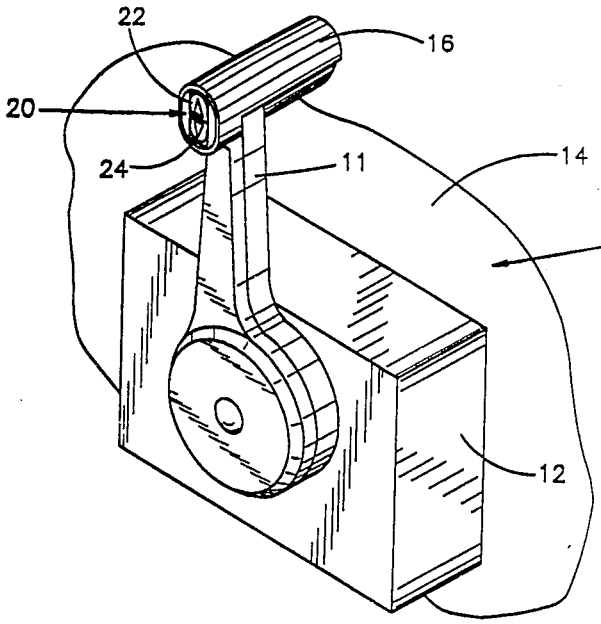
FIG. 1 is a perspective view of a motor boat throttle control.

Turning now to the drawings, FIG. 1 depicts a motor boat throttle control 10 comprising an elongated arm 11 pivotally connected to a control box 12 having circuitry for sending speed control signals to a motor boat. The control box 12 is mounted in an upright manner to a boat sidewall 14. The throttle control has an elongated handle 16 to facilitate user operation of the throttle.

Mounted within the handle 16 is a trim control switch 20 having user engageable contact surfaces 22, 24 that are flush with one end of the handle 16. By activating the switch 20 the boat operator can raise and lower the motor in a controlled fashion to adjust the motor trim. In the vicinity of the throttle 10 the switch 20 will likely come in contact with water and more particularly water may seep between an interface between the switch 20 and throttle handle 16.

A second trim switch similar in construction to that shown in FIG. 1 is typically mounted at the rear of the boat and is utilized in parallel with the switch 20 for controlling motor trim. This second switch is particularly useful for raising and lowering the motor with the boat out of the water to assure proper motor orientation during towing and the like.

Figures 2, 5, 6:
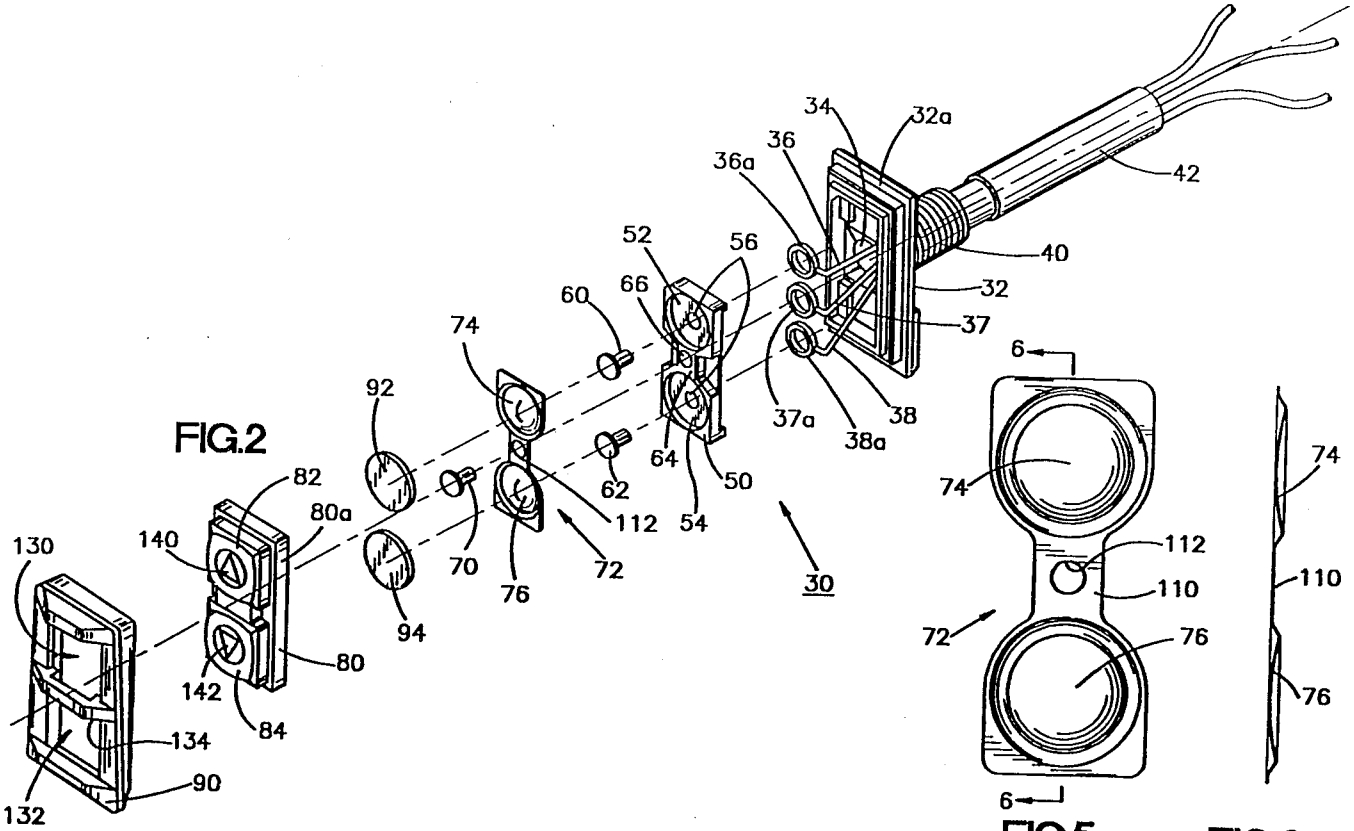
FIG. 2 is an exploded perspective view of components of a trim switch used in conjunction with a motor boat.
FIG. 5 is a plan view of a moveable metallic switch element for bridging two switch contacts.
FIG. 6 is a view as seen from the plane 6—6 of FIG. 5.

An exploded view of the second switch 30 is depicted in FIG. 2. This switch is slightly larger than the switch 20 of FIG. 1 but includes similar internal components for accomplishing switching in response to user engagement of a switch actuation surface. The switch 30 includes a base 32 for mounting the switch 30 at the rear of the boat. A passageway 34 extends through the base to allow three conductors 36, 37, 38 to pass through the base for routing control signals from the switch 30 to a trim actuation system. Each of the conductors 36–38 terminates in an associated ring terminal 36*a*, 37*a*, 38*a*.

The base 32 is coupled to a cylindrical coupling 40 threaded along its outside surface to engage a corresponding threaded opening on the boat mounting surface. The conductors 36–38 are insulated along their length except for a short exposed portion near the ring terminals 36*a*–38*a*. The conductors 36–38 pass through the passageway 34 and aligned coupling 40 to extend away from the switch 30. The insulated conductors are covered by a cylindrical sheath 42 that covers the conductors a short distance as the conductors are routed away from the switch assembly.

A switch body 50 fits within a rectangular recess defined by the base 32 and is ultrasonically welded to the base. The switch body 50 includes two generally circular depressions 52, 54 having openings which pass through the switch body 50 and are generally centered within the circular depressions 52, 54. These openings 56 accommodate switch contacts 60, 62 that extend through the openings 56 in the switch body 50 and are electrically connected to the ring terminals 36*a*, 38*a*. The contacts 60, 62 are permanently affixed to the ring terminals and form a portion of an electrical circuit for controlling the trim setting. An intermediate center portion 64 of the switch body 50 separates the two circular depressions 52, 54 from each other and further defines an opening 66 extending through the body 50 for supporting a third switch contact 70.

The third contact 70 extends through the opening 66 in the switch body 50 and is coupled to the third ring terminal 37*a*. In addition, the switch contact 70 couples a metallic bridging member 72 having side lobes which define recessed domes 74, 76 to the switch body 50. A user engageable switch actuator 80 has two raised actuator surfaces 82, 84 that are generally square in elevation. The actuator 80 covers the bridging member 72 and switch body 50 and is held in place by a switch frame 90 which is ultrasonically welded to the base 32. The switch actuator 80 carries two buttons 92, 94 which fit within circular recesses of an inwardly facing surface of the actuator 80. The buttons define dome contact surfaces curved to conform generally to curved contact surfaces of the switch contacts 60, 62.

User engagement of one of the actuator surfaces 82, 84 pushes an associated one of the buttons 92, 94 into contact with one of the domes 74, 76 to press that dome into engagement with one of the contacts 60, 62. This completes an electric circuit through the contact 70 and one or the other of the contacts 60, 62 via the dome. When the user releases the switch actuator 80 the dome snaps back to its original unstressed shape.

The bridging element 72 is seen in more detail in FIGS. 5 and 6. The side domes 74, 76 are connected by a center portion 110 having an opening 112 to accommodate passage of the contact 70 through both the bridging member 72 and the switch body 50 for contact with the ring terminal 37*a*. The two domes 74, 76 present generally convex surfaces that are recessed with respect to the plane of the center portion 110. (See FIG. 6). Centers of the two domes 74, 76 are normally spaced away from the contacts 60, 62. User actuation deforms one of the domes and brings it into contact with its associated contact. The switch body defines outwardly extending alignment tabs (not shown) which extend above the surface of the intermediate center portion 64 to define a channel. The center portion 110 of the bridging member 72 fits between these two alignment tabs within this channel to properly align and position the domes 74, 76 in relation to the contacts 60, 62.

Figure 3:
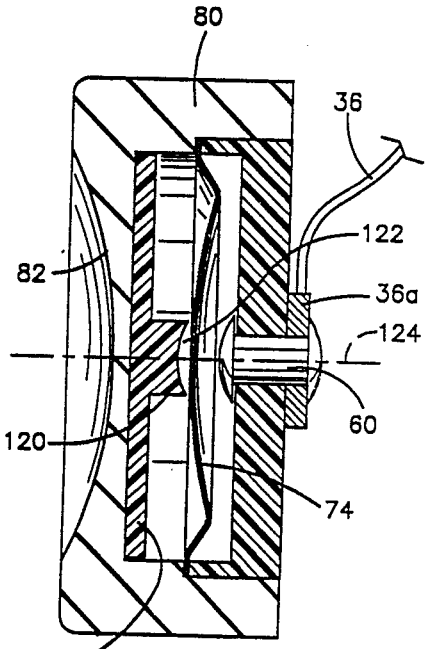
FIG. 3 is a section view of a portion of the assembled trim switch showing a switch contact member and bridging member used in completing a circuit through the trim switch.
Figure 4:
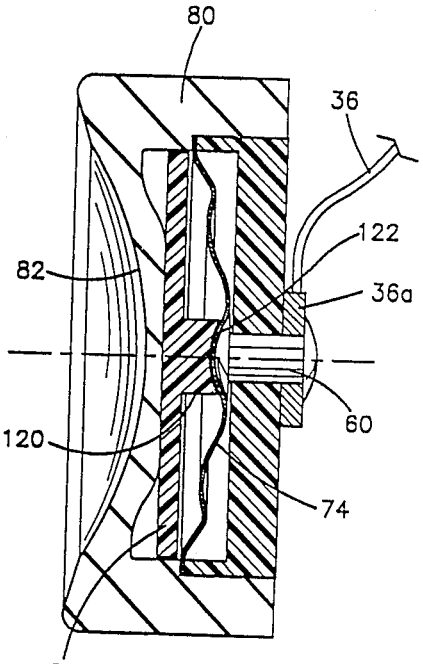
FIG. 4 is a section view of the portion of the trim switch shown in FIG. 3 wherein the switch actuator has been engaged to deform the bridging member bringing it into contact with an extended surface of the switch contact.

The section view of FIG. 3 depicts the arrangement between the dome 74, switch contact 60, switch body 50 and user actuator 80. The actuator frame 90 and base 32 are not shown in either the FIG. 3 or FIG. 4 depiction for clarity.

In FIG. 3, the actuator surface 82 is in its unstressed configuration. The button 92 comprises a plastic material and fits within a recess defined by the elastomeric actuator 80. A projection 120 extends away from the button 92 and defines a generally concave dome contact region 122 aligned with a center line 124 passing through the switch contact 60.

Inward movement of the actuator surface 82 in response to user contact with the switch 30 deforms the actuator 80 in the vicinity of the actuator surface 82 to push the button 92 toward its associated dome 74. Contact between the projection 120 of the button 92 and the dome 74 deforms the dome to a configuration shown in FIG. 4. The projection 120 causes the dome to buckle creating a large contact surface between the dome and the curved convex outward surface of the switch contact 60. This ensures reliable electrical engagement between the dome and the switch contact 60. An electrical circuit is thereby completed through the contact 60 and bridging member 72 which in turn is an electrical engagement with the contact 70. In a similar manner, user actuation of the raised contact surface 84 causes the round button 94 to deform or snap the dome 76 against the contact 62.

The preferred contacts 60, 62, 70 are metal rivets that are pushed through the ring terminals 36*a*, 37*a*, 38*a* and crimped to the terminals thereby fixing the bridging member 72 to the base 50 and electrically coupling all contacts to an associated conductor.

As the dome 74 is deformed to the buckled or convoluted configuration shown in FIG. 4, a tactile indication is transmitted to the user indicating a contact is made. This tactile sensation occurs when the dome 74 is stressed a sufficient amount causing it to snap from the configuration shown in FIG. 3 to the "pushed in" configuration shown in FIG. 4. In addition to the tactile feedback, the snapping in and out of the dome into and out of contact with the switch contact 60 is accompanied by an audible clicking.

The base 32 and frame 90 in combination provide a relatively fluid impermeable enclosure for the switch body 50 and bridging member 72. Both the base 32 and frame are constructed from a plastic material so the base 32 and frame 90 can be ultrasonically welded into a fluid tight arrangement. Inwardly facing surfaces of the frame 90 abut a lip 32*a* extending out around the outer perimeter of the base and subsequent to ultrasonic welding, this interface between frame and base is fluid impermeable. The actuator 80 comprises an elastomer material so that an outer lip 80*a* is compressed around its outer periphery by engagement with an inwardly facing surface of the frame 90. This compression results in a fluid-tight seal in the interface between actuator 80 and frame 90.

The frame 90 defines two equal size openings 130, 132 spaced by a crosspiece 134. With the frame 90 connected to the base 32 the two raised contact surfaces 82, 84 extend through the openings 130, 132 and are substantially co-planar with an outer surface of the crosspiece 134 Two triangle shaped trim control marks 140, 142 are raised slightly above the surfaces 82, 84 and indicate the direction of trim adjustment. The surfaces 82, 84 are dimensioned to allow one's thumb to engage essentially the entire surface 82 or 84 and actuation forces are concentrated through the raised control marks 140, 142.

The base 32, switch body 50, buttons 92, 94 and frame 90 are molded rigid plastic. The actuator is a rubber or other suitable elastomer material. The bridging member is 0.5 thousandths inch thick grade "A" spring temper phosphor bronze which is stamped from a die and stress relieved at 400° F. for 15 to 20 minutes.

The present switch has been described with a degree of particularity. The switch 20 depicted in FIG. 1 is shorter than the switch 30 shown in exploded view in FIG. 2. Both switches, however, utilize the side lobe dome concept in their bridging members to achieve good electrical contact in response to user actuation. Although the embodiment shown in FIG. 2 has been described with a degree of particularity, it is the intent that the invention include all modifications from the disclosed embodiment falling within the spirit or scope of the appended claims.

I claim:

1. Switch apparatus comprising:

(a) a switch base comprising a mounting portion including a through passage for routing signal carrying conductors;

(b) a switch body defining first and second circular depressions located on either side of a center portion that separates said circular depressions; said switch body having three openings extending through said body; where first and second openings extend through said switch body centered within the first and second depressions and a third opening extends through said center portion of the switch body;

(c) first and second metallic switch contacts extending through the openings in the first and second circular depressions for connection to conductors coupled to the contacts, each contact having a curved contact region centered within an associated circular depression and facing away from said switch body;

(d) metallic bridging means coupled to the switch body by a third switch contact extending through the third opening in the center portion of the switch body; said bridging means comprising two domed side lobes spaced from the curved region of the first and second switch contacts; and (e) a switch actuator including first and second spaced dome engaging buttons carried by an elastic material, each button defining a projection having a curved projection surface for contacting a middle portion of an associated one of said first and second domed side lobes to deform said associated one of said dome side lobes into curved engagement with an associated one of said first and second metallic switch contacts and complete a circuit path between said associated one of said first and second metallic switch contacts and the third switch contact.

2. Switch apparatus comprising:

(a) a switch body having first, second and third openings extending through said switch body;

(b) first and second switch contacts extending through the first and second openings, each of said first and second switch contacts having a curved contact region facing away from said switch body;

(c) first and second domes coupled by a central portion, the central portion coupled to the switch body by a third switch contact extending through the third opening in the switch body; and (d) a switch actuator including first and second spaced dome engaging projections, each projection having a curved projection surface for contacting a middle portion of one of said first and second domes to deform said one of said domes into curved engagement with one of said first and second switch contacts and complete a circuit path between said one of said first and second switch contacts and the third switch contact.

3. The apparatus of claim 2 wherein the switch contacts comprise rivets having enlarged ends facing away from the switch body.

4. The apparatus of claim 2 wherein the actuator comprises a cover having user engageable surfaces marked with indicia indicating the results which actuation of the switch apparatus produces through energization of a circuit.

5. The switch apparatus of claim 2 wherein the switch actuator includes an elastomeric material.

6. The switch apparatus of claim 5 additionally comprising:

(a) a base defining a recess for receiving the switch body, said recess having a bottom surface abutted by side walls configured to accept the switch body within the recess, said base having a through passage opening into the recess to accommodate passage of conductors coupled to the metal switch contacts of the switch apparatus, and (b) a frame for sealingly engaging the base, said frame defining a contact surface that engages the actuator to compress an outer perimeter of the elastomeric material and form a seal between the frame and actuator.

7. The switch apparatus of claim 5 additionally comprising first and second plastic buttons that fit in recesses of said elastomeric material and that each mount one of said first and second dome engaging projections for engagement with one of said first and second domes in response to user contact with the actuator.

8. Switch apparatus comprising:

(a) a switch base including a sheath portion;

(b) a switch body fitting into a recess in the switch base and having first, second and third openings extending through the body;

(c) first and second switch contacts extending through the first and second openings in the switch body;

(d) first and second domes coupled by a central portion, the central portion coupled to the switch body by a third switch contact extending through the third opening in the switch body;

(e) three conductors, each conductor coupled to one of said first, second and third switch contacts and extending through the sheath portion of the switch base for communication with a circuit outside the switch apparatus;

(f) a switch actuator including an elastic material having a contact portion and a flange portion for cooperating with the switch base to enclose the switch body and domes, said contact portion constructed and arranged for contacting a middle portion of one of said first and second domes to deform said one of said domes into engagement with one of said first and second switch contacts so as to complete a circuit path between said one of said first and second switch contacts and the third switch contact; and (g) a switch frame engaging the switch base for compressing the flange portion of the elastic material against the switch base and forming a gasket seal around the switch contacts and domes, the switch frame having an opening for exposing the contact portion of the elastic material.

9. A switch apparatus according to claim 8 wherein the contact portion of the elastic material includes a pair of raised portions and the switch frame opening is divided into two parts by a crosspiece.

10. A switch apparatus according to claim 8 wherein the conductors each comprise a ring terminal coupled to a lead and wherein the switch contacts each comprise rivets passing through one of said ring terminals and having an enlarged end facing away from the switch body.

11. Switch apparatus comprising:

(a) a switch body defining first and second circular depressions located on either side of an intermediate center portion that separates said circular depressions;

(b) first, second and third openings extending through the body, the first and second openings centered within the first and second depressions and the third opening extending through the intermediate center portion of the switch body;

(c) a pair of alignment tabs extending from the surface of the intermediate center portion of the switch body forming a channel between the depressions;

(d) first and second switch contacts extending through the first ad second circular openings, each contact having a contact region centered within an associated circular depression and facing away from said switch body; and (e) first and second domes coupled by a central portion so that the first and second domes are each centered over one of said first and second circular depressions when the central portion is positioned in the channel formed between the alignment tabs on the intermediate center portion of the switch body;

(f) said central portion coupled to the switch body by the third switch contact so that the first and second domes are positioned for deformation of one of said domes into engagement wit one of said first and second switch contacts to complete a circuit path between said one of said first and second switch contacts and the third switch contact.

* * * * *